US005082258A

United States Patent [19]

Niks

[11] Patent Number: 5,082,258

[45] Date of Patent: Jan. 21, 1992

[54] EXERCISING DEVICE FOR PIANISTS AND THE LIKE

[76] Inventor: Mikhail Niks, 1434 Fulbright Ave., Redlands, Calif. 92373

[21] Appl. No.: 680,918

[22] Filed: Apr. 5, 1991

[51] Int. Cl.[5] ..... A63B 5/00

[52] U.S. Cl. ..... 272/67; 128/26; 84/467

[58] Field of Search ..... 128/26; 272/67; 84/467, 84/469; 434/227, 231

[56] References Cited

U.S. PATENT DOCUMENTS

| | | | |
|---|---|---|---|
| 248,980 | 11/1881 | Atkins | 272/67 |
| 272,951 | 2/1883 | Gardner | 272/67 |
| 494,197 | 3/1893 | Hall | 84/467 |
| 585,799 | 7/1897 | Thompson | 272/67 |
| 1,126,938 | 2/1915 | Barrett | 128/26 |
| 4,765,608 | 8/1988 | Bonasera | 272/67 |

FOREIGN PATENT DOCUMENTS

| | | | |
|---|---|---|---|
| 9019 | 3/1902 | Austria | 84/467 |
| 5465 | 6/1879 | Fed. Rep. of Germany | 84/467 |
| 8320 | 8/1844 | France | 84/467 |

*Primary Examiner*—Richard J. Apley
*Assistant Examiner*—Lynne A. Reichard
*Attorney, Agent, or Firm*—John H. Crowe

[57] ABSTRACT

An exercising device for pianists including a bar adapted to extend along the length of a piano keyboard to form an initial rest for the pianist's wrists and to ensure proper positioning of the wrists during playing. Finger guide units are adjustably mountable on the bar to guide movement of the fingers to ensure proper development of and prevent injury to finger muscles, as well as other muscles. Adjustable supports for the bar are provided to permit its positioning relative to the keyboard to accommodate the pianists's physical characteristics and to enable it to be used with any of various keyboards of different sizes and shapes.

15 Claims, 2 Drawing Sheets

EXERCISING DEVICE FOR PIANISTS AND THE LIKE

BACKGROUND OF THE INVENTION

1. Field of the Invention

This invention relates to a device for use in exercising and developing finger and other muscles and has particular reference to such a device for use in exercising the finger, wrist and arm muscles of pianists and players of other keyboard musical instruments in order to accelerate and make more effective the crucial period of acquiring basic technique skills and also to aid in the retraining of pianists with previously acquired bad habits.

2. Background of the Invention

To achieve proficiency in playing a piano or other keyboard musical instrument, a player must practice over long periods of time to develop suitable finger, wrist and arm muscle strength and coordination to the point where the coordination becomes automatic and the muscles perform to produce the desired sounds without undue tiring.

During supervised weekly lessons, burdened with many problems in need of correction, the physical approach of the student player is usually neglected, and during the rest of the week, when the student is without supervision, he or she tends to build incorrect habits. As a result, the process of acquiring basic piano playing techniques, which is crucial for proper future playing skills, becomes too complicated, too long, too ineffective, and even potentially dangerous in that it can lead to the onset of tendonitis. This is inflammation of the lining of the tendon sheath and the enclosed tendon resulting from muscle overuse and misuse.

I have observed that piano teachers do not use any physical aids to facilitate proper piano playing techniques. Also, piano students have not had any tool or device for proper self control when practicing alone. My proposed device is easily attachable to a piano or the like and serves to train proper muscles of the fingers and wrists during piano lessons and also as a tool for self control by a student practicing alone, thus preventing bad habits from building up as well as overtiring of the muscles.

My novel device forces the student to follow my (Niks) technique of piano playing, the main principle of which involves resting of the arm on two points of support without tension in the wrist area, the two points being the shoulder joint at one end and the fingers resting on the keys at the opposite end. The effectiveness of this technique was demonstrated in a medical experiment conducted in 1989 at Los Amigos Medical Center in Downey, Calif. and favorably reported by the Department of Pathokinesiology of that center. It was also demonstrated during a period of experimental use by students and teachers using my device.

SUMMARY OF THE INVENTION

It is therefore a principal object of the present invention to provide a device for training a pianist or the like to properly coordinate movements of his or her fingers, wrists and arms for operation of a keyboard instrument during music lessons and while practicing alone to produce a pleasing and powerful sound output and fast, even finger technique in the shortest time with minimal physical abuse of the affected muscles.

Another object of the invention is to provide such a device forming a base for initially locating the player's fingers, wrists, etc. so that he or she can operate the keyboard with a minimum of tension.

Still another object of the invention is to provide a device for training a pianist to use his or her finger, wrist and arm muscles in a way to distribute stresses involved in operating a piano keyboard among such muscles and thus minimize stress on any muscle.

Yet another object of the invention is to provide a device of the above-indicated type which is readily adjustable to accommodate players of differing sizes and other physical characteristics.

A further object of the invention is to provide such a device which is readily adaptable for use on pianos or the like of various sizes and shapes.

A still further object of the invention is to provide such a device of simple construction which is economical to manufacture.

Other objects, features and advantages of the invention will become apparent in the light of the following disclosure.

In the device of this invention, a support bar is provided to extend along the length of the keyboard of a musical instrument and means are included to adjust it both vertically and toward and away from the keyboard in accordance with the size and other physical characteristics of a player. The support bar forms a rest for the player's wrists in an initial position. Also, when the user of the device is playing with a wrist located slightly above the bar, the bar prevents the wrist from dropping, this dropping being a constant problem beginners have which leads to sloppy playing and tension in the wrist and fingers. Finger guide units are mounted on the bar and carry finger guide elements or balls on elongate flexible members, one for each of the player's fingers, excluding his or her thumbs, to properly guide the fingers during use of the device, as will be seen. Training with the finger balls has, as a goal, the creation of equal working conditions for each finger. Also, it forces the pianist to engage only the proper muscles of the fingers and wrists, thereby eliminating undesirable tension. And it helps lead the beginning player in the right direction to avoid incorrect, clumsy finger movements which result in slow, uneven finger technique.

The device is normally adjusted for use so that the third phalanx or outer section of each finger can rest on an underlying key and extend vertically in engagement with a respective finger guide element. The wrist should then rest on the support bar with the back of the palm of the hand extending substantially horizontally and the arms hanging loosely by the player's sides with the elbow not higher than the surface of the keyboard. With each hand and arm so positioned, various initial exercises can be carried out by the user to exercise his fingers, wrists and arms both individually or in cooperative relation with each other to develop various finger, wrist and arm muscles and bring about coordination therebetween with a minimum of tension.

BRIEF DESCRIPTION OF THE DRAWINGS

The manner in which the above and other objects of my invention are accomplished will be readily understood from the following specification considered in conjunction with the accompanying drawings, wherein.

DESCRIPTION OF THE PREFERRED EMBODIMENT

Figures 1, 5:
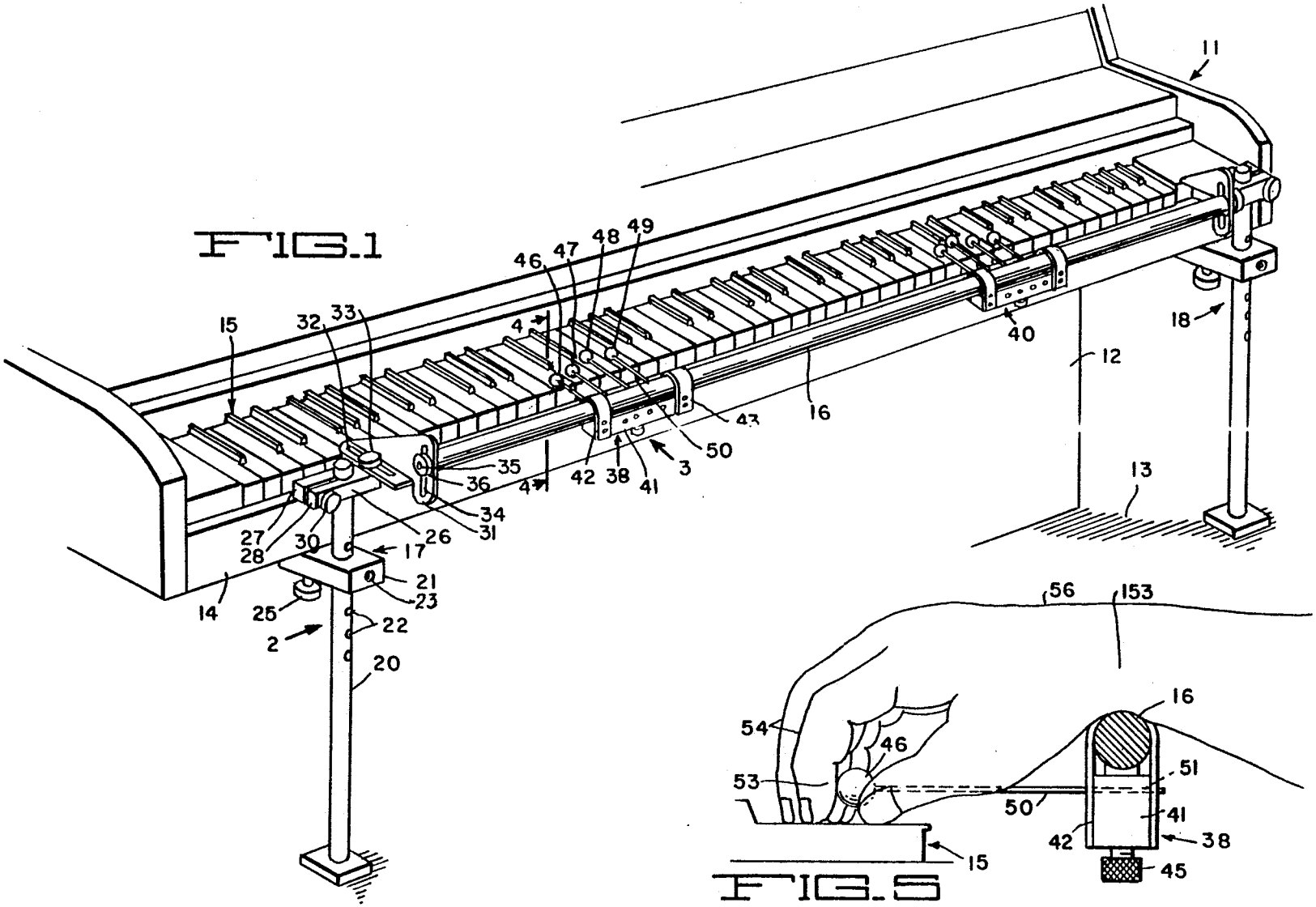
FIG. 1 is a perspective view of a piano and associated exercising device embodying a preferred form of the present invention.
FIG. 5 is a sectional view similar to FIG. 4 but illustrating a player's hand and arm in an initial or resting position on the device.
Figure 2:
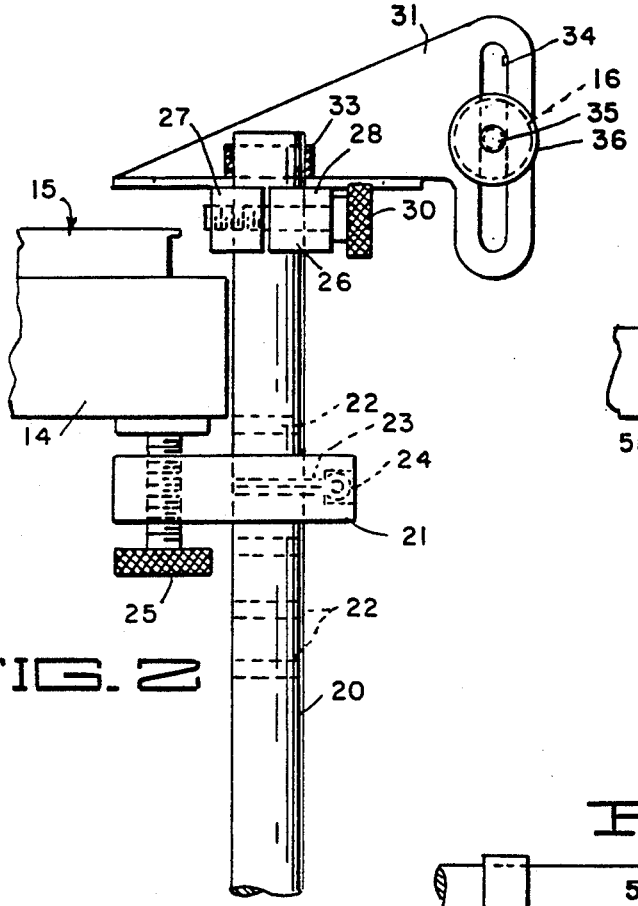
FIG. 2 is a side elevational view of one of a pair of support bracket assemblies for a support bar forming part of the exercising device, taken in the direction of arrow 2 in FIG. 1.

Referring first to FIG. 1, a conventional piano is generally indicated at 11 and comprises a piano body partially shown at 12 and resting on a floor 13. The piano includes a keyboard base 14 over which is mounted a keyboard 15.

A cylindrical support bar 16 is extended along the length of the keyboard and supported at its ends by a pair of similar support units generally indicated at 17 and 18. Each support unit comprises a vertical leg 20 which rests on the floor 13. A plurality of vertically spaced holes 22 are formed in the leg. A bracket 21 is slidably mounted on the bar 20 and has a hole 23 therein to receive a pin 24 which may be passed through any of the holes 22 to locate the bracket 21 at a desired height relative to the keyboard base 14. A clamp screw 25 is threaded vertically through the bracket 21 to engage the underside of the keyboard base 14 and thus lock the leg 20 in position.

Means are provided to adjustably support the adjacent end of the support bar 16 in fixed position on the leg 20. For this purpose, a second bracket 26 is slidably mounted on the upper end of leg 20 and is partially split to form two sections 27 and 28. A clamp screw 30 is slidably mounted in the section 28 and is threaded through section 27 to flex the sections 27 and 28 to clamp the bracket 26 in a suitable position on the leg.

An angle piece 31 is adjustably mounted on the bracket 26 and for this purpose has an elongate slot 32 therein through which a clamp screw 33 is passed, the latter being threaded in the bracket 26 to enable the piece 31 to be clamped in different positions toward and away from the keyboard 15.

A vertical elongate slot 34 is formed in piece 31 to receive a threaded stud 35 fixed in the adjacent end of the support bar 16, and a clamp nut 36 threadedly engages the stud to clamp the bar 16 in a suitable vertical and rotated position.

Figure 3:
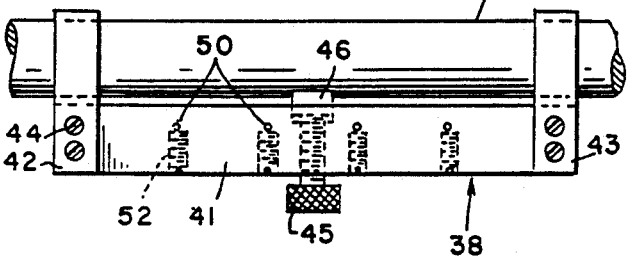
FIG. 3 is a front view of part of the support bar and a finger guide unit forming part of the device, taken in the direction of the arrow 3 in FIG. 1.

A pair of similar finger guide units 38 and 40 (see also FIGS. 3, 4 and 5) are mounted on the support bar 16 for locating a player's fingers in playing positions. For this purpose, each finger guide unit comprises a block 41 supported at its ends by bar 16 by means of bearing straps 42 and 43 secured thereto by screws 44. The straps are rotatable about the bar 16 to enable the block to be moved along the bar and also rotatably thereabout. A clamp screw 45 is threaded in the block 41 and abuts a plunger 46 engageable with the bar. Thus, screw 45 can lock the block 41 in different positions about and along the length of the bar 16.

A set of four finger engaging balls 46, 47, 48 and 49 are permanently mounted on respective flexible rods 50 which are fitted in holes 51 extending through the block 41 at intervals therealong equal to the spacing between adjacent ones of the keys of the keyboard. Lock screws 52 are threaded into the block 41 to engage the rods and thus secure the same in different positions corresponding to the differing lengths of players' fingers. This positioning is preferably such that when a player's wrist 153 rests initially on or near the support bar 16, as seen in FIG. 5, the inner surface of the outer or third phalanx 53 of each of the player's fingers 54 will rest comfortably against the surface of a respective one of the balls when extending vertically. The back and forth adjustment of the finger guide units relative to a keyboard to make this possible is accomplished through movement of support bar 16 toward or away from said keyboard.

Figure 4:
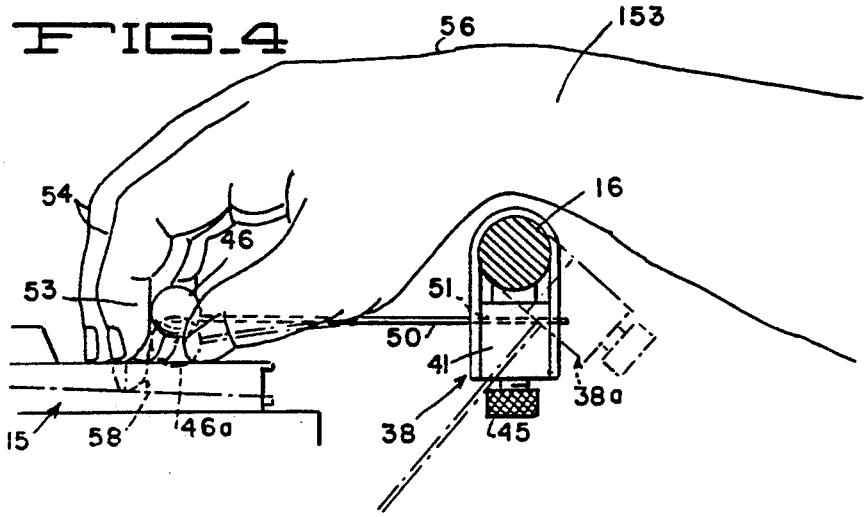
FIG. 4 is a transverse sectional view of the device taken along the line 4—4 of FIG. 1 and showing a player's hand and part of his arm in playing position relative to the device.

The guide units 38 and 40 are preferably adjusted along the length of bar 16 to enable the player's forearms to extend parallel with each other and are adjusted rotatably to normally maintain the balls 46–49 a short distance above the respectively aligned keys of the keyboard and preferably midway along the length of each outer finger phalanx 53, as seen in FIGS. 4 and 5.

Various exercises may be performed using the device to effect proper development of different finger, etc., muscles and to develop proper coordination. For example, in one such exercise, each of the player's arms is hung loosely and each wrist 153 rests on the bar 16 as shown in FIG. 5. The outer phalanx 53 of each finger rests on a respective key and extends vertically while touching a ball and the back 56 of the hand extends horizontally. Now, each of the player's wrists is repeatedly raised to its position shown in FIG. 4 then returned to its FIG. 5 position, for a suitable time period.

In another exercise, the above-described procedure is repeated but one or more of the fingers 54 is depressed as indicated by the dotted lines 58 in FIG. 4 to depress the underlying key(s) while also depressing the aligned ball(s), e.g., depressing ball 46 into its dotted line position 46*a*, and help support the arm at the two points of support referred to above (shoulder and finger or fingers).

In the event it is desired to operate the piano in the usual manner without the guide units 38 and 40, the latter may be released and slid to outermost positions on the support bar 16 where they can be rotated into their dotted line positions, as exemplified at 38*a* (FIG. 4), so they will not interfere with the player. The player can, however, continue to rest his arm(s) on their shoulder and finger(s) points of support.

Figure 6:
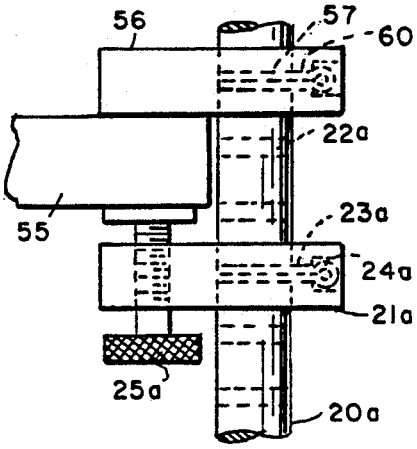
FIG. 6 is a fragmentary elevational view of an alternative form of supporting means for the support bar.

FIG. 6 illustrates a modified form of the invention for supporting the support bar relative to a table mounted keyboard (not shown) or a pictorial representation of a keyboard mounted on the table. Here, in lieu of the piano, a table comprising a table top 55 is provided which is suitably supported by the floor in a manner not shown. This bar support unit, similarly to each of the support units 17 and 18 of FIG. 1, has a leg 20*a*, along with a bracket 21*a* and clamp screw 25*a* corresponding to bracket 21 and clamp screw 25 of the latter units, respectively. Bracket 21*a* is fastened to the leg 20*a* similarly to the way bracket 21 is fastened to leg 20 by means of a pin 24*a* inserted through a hole 23*a* in the bracket and a preselected one of a plurality of holes 22*a* in the leg. However, an additional bracket 56 is here slidably mounted on the leg 20*a* and secured in a position overlying the table top 55 by a pin 57 fitted into a hole 60 in the bracket and through another of the holes 22a in the leg. The clamp screw 25a is adjusted to clamp against the bottom of the table top 55 and thus secure the leg 20a in rigid position to support the adjacent end of the support bar 16. Thus, the lower end of the leg 20a need not engage the floor 13 and may, if desired, be cut off anywhere below the bracket 21a.

Various designs, materials of construction and means of attachment to a keyboard instrument of my novel device are possible within the scope of my invention which is limited only by the language of the following claims.

I claim:

1. A device for use in exercising only the proper muscles of the fingers and arms of a player of a keyboard instrument, to eliminate wrong and unnecessary movements which cause tension and slow down the aquisition of basic piano techniques, comprising:

a bar, means for supporting said bar to extend along the length of the keyboard of said instrument and at a height to initially engage the underside of a player's wrist and prevent it from dropping during playing of the instrument;

a finger guide unit on said bar, and a plurality of finger guide elements carried by said unit for locating respective ones of said player's fingers over different ones of said keys of said keyboard, said finger guide elements being effective to guide said player's fingers vertically against said keys.

2. A device as defined in claim 1 wherein each of said finger guide elements is engageable by the rear of a respective one of said fingers, and includes support means extending horizontally from said finger guide unit for supporting said finger guide elements above said keyboard, said support means being adapted to permit depression of said keys independently of each other.

3. A device as defined in claim 2 wherein said support means comprises means for locating said finger guide elements at different distances from said bar.

4. A device as defined in claim 2 wherein said support means comprises a plurality of elongate flexible elements carried by said unit for supporting respective ones of said finger guide elements, each of said flexible elements being adapted to yield vertically upon depression of a respective one of said finger guide elements by a respective one of said fingers.

5. A device as defined in claim 4 wherein said plurality of finger guide elements comprises four such elements.

6. A device as defined in claim 4 including means for securing said finger guide elements in different positions about said bar.

7. A device as defined in claim 4 wherein said bar is cylindrical and said finger guide unit has bearings slidable and rotatable about said bar, and which includes means for selectively securing said finger guide unit in different positions on said bar.

8. A device as defined in claim 1 including means for securing said finger guide unit to said bar in different positions along the length of said bar.

9. A device as defined in claim 1 wherein the bar supporting means comprises means for supporting said bar in different positions vertically relative to the level of said keyboard.

10. A device as defined in claim 1 wherein the bar supporting means comprises means for supporting said bar in different positions toward and away from said keyboard.

11. A device as defined in claim 1 including more than one finger guide unit on said bar and means for securing them in different positions on said bar.

12. A device as defined in claim 1 wherein said finger guide elements are movable about the axis of said bar to position them free and clear of the space above said keyboard as well as the space above the level of said bar.

13. A device for use in exercising the finger and other muscles of a player of a keyboard musical instrument comprising a keyboard, a base for said keyboard and means for supporting said base above a supporting floor, said device comprising:

a bar, support means for supporting said bar to extend along the length of said keyboard and at a height to support a wrist of said player by engaging the underside of said wrist, said support means comprising:

a vertical leg supported by said floor, a bracket on said leg, vertically adjustable means on said bracket for engaging the underside of said base, and means on said leg for supporting said bar in alternative positions relative to said keyboard, a finger guide unit on said bar, and a plurality of finger guide elements carried by said finger guide unit for locating different ones of said player's fingers over different keys on said keyboard, said finger guide elements being effective to independently guide the player's fingers vertically against said respective keys.

14. A device for use in exercising only the proper muscles of the fingers and arms of a player of a keyboard instrument, to eliminate wrong and unnecessary movements which cause tension and slow down the acquisition of basic piano techniques, comprising:

a bar;

means for supporting said bar to extend along the length of the keyboard of said instrument and at a height to initially support a player's wrist and prevent it from dropping during playing of the instrument;

a finger guide unit on said bar; and a pluality of finger guide elements carried by said finger guide unit for locating respective ones of said player's fingers over different ones of said keys of said keyboard, said finger guide elements being effective to guide said player's fingers vertically against said keys;

each of said finger guide elements being engageable by the rear of a respective one of said fingers and including support means extending from said finger guide unit for supporting said finger guide elements above said keyboard, said support means being adapted to permit depression of said keys independently of each other and comprising a plurality of elongate flexible elements carried by said finger guide unit for supporting respective ones of said finger guide elements, each of said flexible elements being adapted to yield vertically upon depression of a respective one of said finger guide elements by a respective one of said fingers;

said device including means for securing said flexible elements in different relative positions on said finger guide unit.

15. A device for use in exercising only the proper muscles of the fingers and arms of a player of a keyboard instrument, to eliminate wrong and unnecessary movements which cause tension and slow down the acquistion of basic piano techniques, comprising:

a bar;

means for supporting said bar to extend along the length of the keyboard of said instrument and at a height to initially support a player's wrist and prevent it from dropping during playing of the instrument;

a finger guide unit on said bar; and a plurality of finger guide elements carried by said unit for locating respective ones of said player's fingers over different ones of said keys of said keyboard, said finger guide elements being effective to guide said player's fingers vertically against said keys and each having a spherical surface engageable by a respective one of said player's fingers;

each of said finger guide elements being engageable by the rear of a respective one of said fingers and including support means extending from said finger guide unit for supporting said finger guide elements above said keyboard, said support means being adapted to permit depression of said keys independently of each other and comprising a plurality of elongate flexible elements carried by said unit for supporting respective ones of said finger guide elements, each of said flexible elements being adapted to yield vertically upon depression of a respective one of said finger guide elements by a respective one of said fingers.

* * * * *